US009097112B2

(12) United States Patent
Meline

(10) Patent No.: US 9,097,112 B2
(45) Date of Patent: Aug. 4, 2015

(54) METHOD FOR ANCHORING A DEVICE IN MULTILAYER SOIL

(71) Applicant: SOCIETE INDUSTRIELLE DE PRODUITS MECANIQUES ANCR'EST, Saint Avold (FR)

(72) Inventor: Christian Meline, SCY Chazelles (FR)

(73) Assignee: Societe Industrielle de Produits Mecaniques Ancr'Est, Saint Avold (FR)

( * ) Notice: Subject to any disclaimer, the term of this patent is extended or adjusted under 35 U.S.C. 154(b) by 0 days.

(21) Appl. No.: 14/605,139

(22) Filed: Jan. 26, 2015

(65) Prior Publication Data

US 2015/0132068 A1 May 14, 2015

Related U.S. Application Data

(62) Division of application No. 13/143,529, filed as application No. PCT/FR2009/052578 on Dec. 16, 2009.

(30) Foreign Application Priority Data

Jan. 6, 2009 (FR) ..... 09 50051

(51) Int. Cl.

| | |
|---|---|
| ***E02D 5/80*** | (2006.01) |
| ***E21D 21/00*** | (2006.01) |
| ***E21D 20/02*** | (2006.01) |
| ***E02D 1/02*** | (2006.01) |
| ***E02D 7/22*** | (2006.01) |
| ***E21D 20/00*** | (2006.01) |

(52) U.S. Cl.

CPC ..... *E21D 20/028* (2013.01); *E02D 1/02* (2013.01); *E02D 5/801* (2013.01); *E02D 5/808* (2013.01); *E02D 7/22* (2013.01); *E21D 20/003* (2013.01); *E21D 20/021* (2013.01); *E21D 20/025* (2013.01)

(58) Field of Classification Search

CPC ..... E02D 5/808; E02D 5/80; E02D 5/801; E02D 5/56; E02D 5/22; E21D 21/008; E21D 21/0026

USPC ..... 405/231, 233, 248, 249, 252.1, 253, 405/258.1, 259.1, 259.5, 263, 266, 269; 52/155, 156, 157

See application file for complete search history.

(56) References Cited

U.S. PATENT DOCUMENTS

| | | | |
|---|---|---|---|
| 5,740,684 | A | 4/1998 | Sherlock et al. |
| 2007/0286687 | A1 | 12/2007 | Melegari |

FOREIGN PATENT DOCUMENTS

| | | | |
|---|---|---|---|
| DE | 3 400 182 | A1 | 7/1985 |
| DE | 4 201 419 | C1 | 8/1993 |
| FR | 2 863 633 | A | 6/2005 |

OTHER PUBLICATIONS

International Search Report dated May 27, 2010, issued in PCT/FR2009/052578.

*Primary Examiner* — Benjamin Fiorello
*Assistant Examiner* — Stacy Warren
(74) *Attorney, Agent, or Firm* — Knobbe Martens Olson & Bear, LLP

(57) ABSTRACT

A method for anchoring a device in multilayer soil includes analyzing the soil to determine the depth, hardness and density of at least two layers of soils. The anchoring device is prepared for positioning by attaching a self-drilling bit to a bottom end of a hollow rod, attaching a drilling disc to the rod at a position above the self-drilling bit, attaching at least one helical disc to the rod above the drilling disc, and attaching a positioning plate to the rod at a distance from the drilling disc such that the distance from the bottom of the drilling disc to the bottom of the positioning plate is approximately equal to the depth of a first layer of soil. The anchoring device is drilled into the soil until the drilling disc rests on top of the second layer and the positioning plate rests on top of the first layer.

20 Claims, 5 Drawing Sheets

METHOD FOR ANCHORING A DEVICE IN MULTILAYER SOIL

RELATED APPLICATIONS

This application is a divisional application of U.S. application Ser. No. 13/143,529, filed on Dec. 16, 2009, which is the U.S. National Phase of International Application No.: PCT/FR2009/052578, filed Dec. 16, 2009, designating the U.S., and published in French as WO 2010/079277 on Jul. 15, 2010 which claims the benefit of French Patent Application No. 09 50051 filed Jan. 6, 2009.

FIELD OF THE INVENTION

The present invention relates to a device for anchoring in multilayer soil, of the type having a hollow rod whereof a first end receives a fastening means and whereof the opposite free end is intended to drill into the soil.

BACKGROUND OF THE INVENTION

Two types of anchoring devices are known, each adapted to anchoring in specific soils. The anchoring, whether on land or water, of buildings or structures can in fact be performed on loose soils or harder soils. Screw anchoring devices, having one or more attached helical discs welded on a rod, are therefore provided for loose soils. These screw anchors can thereby stabilize the structure to be anchored, once the first loose soil layer is thick enough.

Aside from this first problem related to the environment in which this type of device must be used, another drawback is that this type of screw anchoring device cannot be used in layers of hard soils. Self-drilling anchoring devices are provided in the case of these hard soils, in which devices the rod is provided at its end with a bit able to dig into the soil and whereof the dimension larger than the diameter of the rod makes it possible to create a cavity in which cement is injected to secure the anchoring with the ground. Such a self-drilling device does, however, have the drawback of not adapting to softer soils.

However, the anchoring structure can be made in a soil with varying hardness, formed from the surface by a first layer of loose soil, then a second monolithic layer. The use of one or the other of the devices mentioned above does not allow satisfactory anchoring of the structure. The first layer of loose soil has too small a thickness to stabilize a screw anchoring device, and the use of self-drilling anchoring is made impossible by the depth to which the second layer extends, the distance to the surface risking destabilizing the self-drilling anchoring.

SUMMARY OF THE INVENTION

The present invention aims to propose an anchoring device that allows solid anchoring in soils with variable thicknesses and/or different hardnesses, as mentioned above.

To that end, the invention proposes a device for anchoring in multilayer soil, of the type having a hollow rod whereof a first end receives a fastening means and whereof the free opposite end is intended to drill into the ground, in which a positioning plate is mounted on the hollow rod and is intended to bear on the surface of the soil, the rod successively supporting, from the positioning plate towards the free end, at least one helical disc then a drilling disc, characterized in that the rod extends beyond the drilling disc opposite the positioning plate, and in that a bit is arranged on the free end of said rod, such that a first portion of the rod, suitable for being screwed into at least one first soil layer, extends from the positioning plate to the drilling disc, and such that a second portion of the rod, suitable for anchoring in a second soil layer, extends from the drilling disc to the bit.

Such a device allows resistant structure anchoring, the first part of the rod being intended to be screwed into a first soil layer, for example loose, which extends over a second layer of soil, for example monolithic and consolidated of the rocky type, harder than the first soil layer, and in which the second part of the rod is suitable for being anchored.

According to different features of the present invention:

- the bit has a diameter larger than the diameter of the rod;
- the at least one helical disc and the drilling disc are welded on the rod;
- a cylindrical casing is formed around the first part of the rod, between the positioning plate and the helical disc closest to the plate;
- a cylindrical casing is formed around the first part of the rod, between the positioning plate and the drilling disc,
- the cylindrical casing has a variable diameter whereof the smallest diameter is larger than the diameter of the second part of the rod,
- the cylindrical casing has a first section extending from the positioning plate and having a first diameter followed by a second section extending to the drilling disc and having a second diameter smaller than the first diameter and larger than the diameter of the second part of the rod,
- the hollow rod is threaded over at least the second part extending between the drilling disc and the bit, and in that this hollow rod is smooth in the first part surrounded by the cylindrical casing;
- at least part of the rod and the bit are pierced with holes for injecting a cement or a synthetic resin for anchoring in compact rocky-type soils;
- the holes for injecting cement are pierced only on the second part of the rod and on the bit, and
- the holes for injecting cement or resin are pierced over the first part and the second part of the rod and on the bit.\

BRIEF DESCRIPTION OF THE DRAWINGS

The invention will now be described in more detail but non-limitingly in light of the appended figures and in which.

DETAILED DESCRIPTION OF THE EMBODIMENTS

The anchoring device according to the invention, as illustrated in all of the figures, comprises a hollow rod 2 whereof a first end 21 receives a fastening means (not shown) of a structure or building to be anchored in the soil, the free opposite end 22 of the hollow rod 2 to that end being intended to drill into the soil. This structure is made to be fastened relative to the ground, whether in a land or water application.

Figure 1:
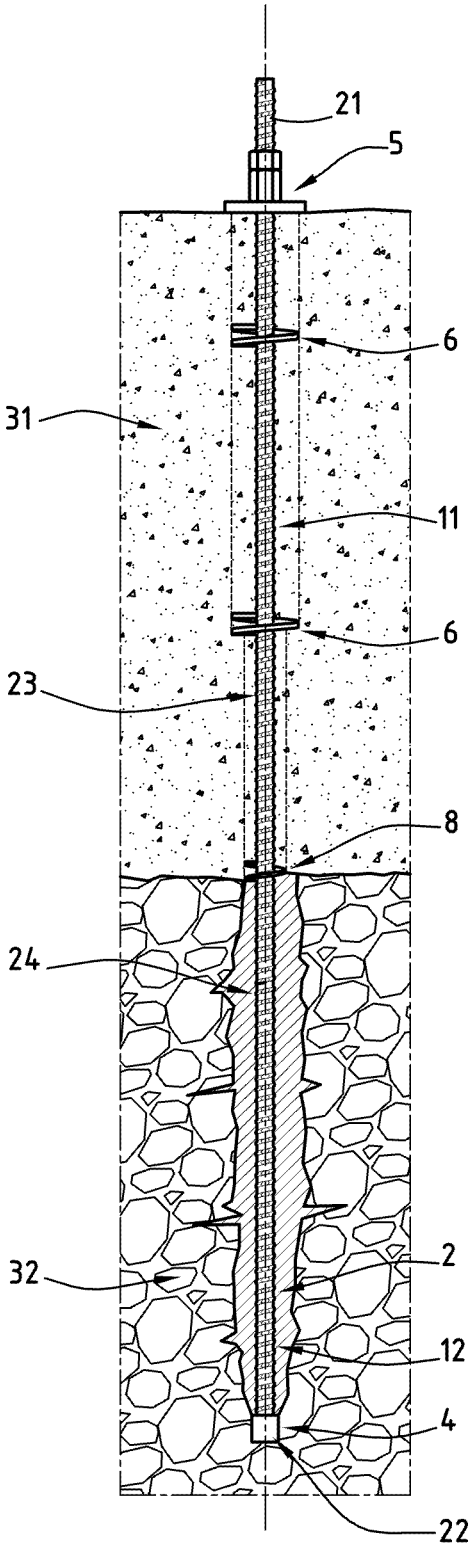
FIG. 1 is a diagrammatic illustration of an anchoring device according to a first embodiment of the invention.
Figure 2:
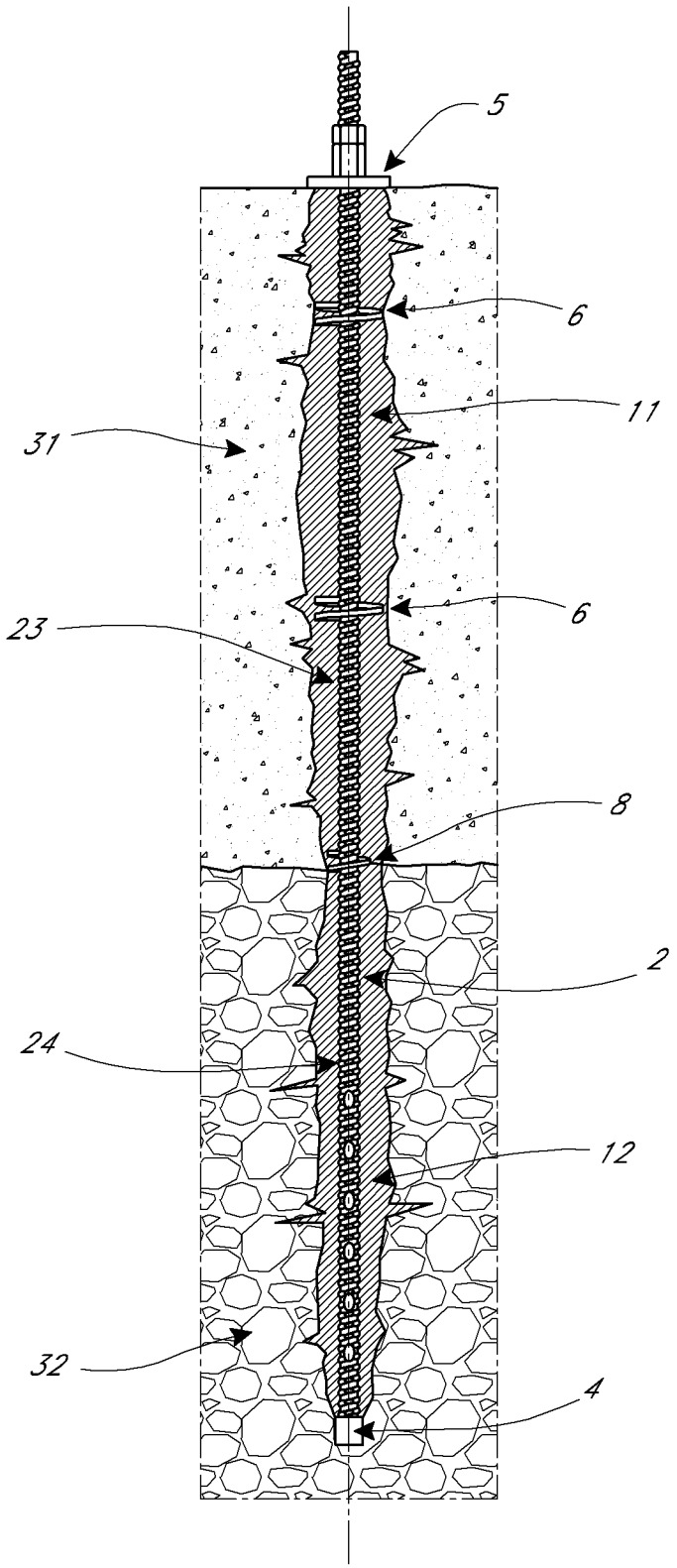
FIG. 2 is a diagrammatic illustration of an anchoring device according to a second embodiment of the invention.
Figure 3:
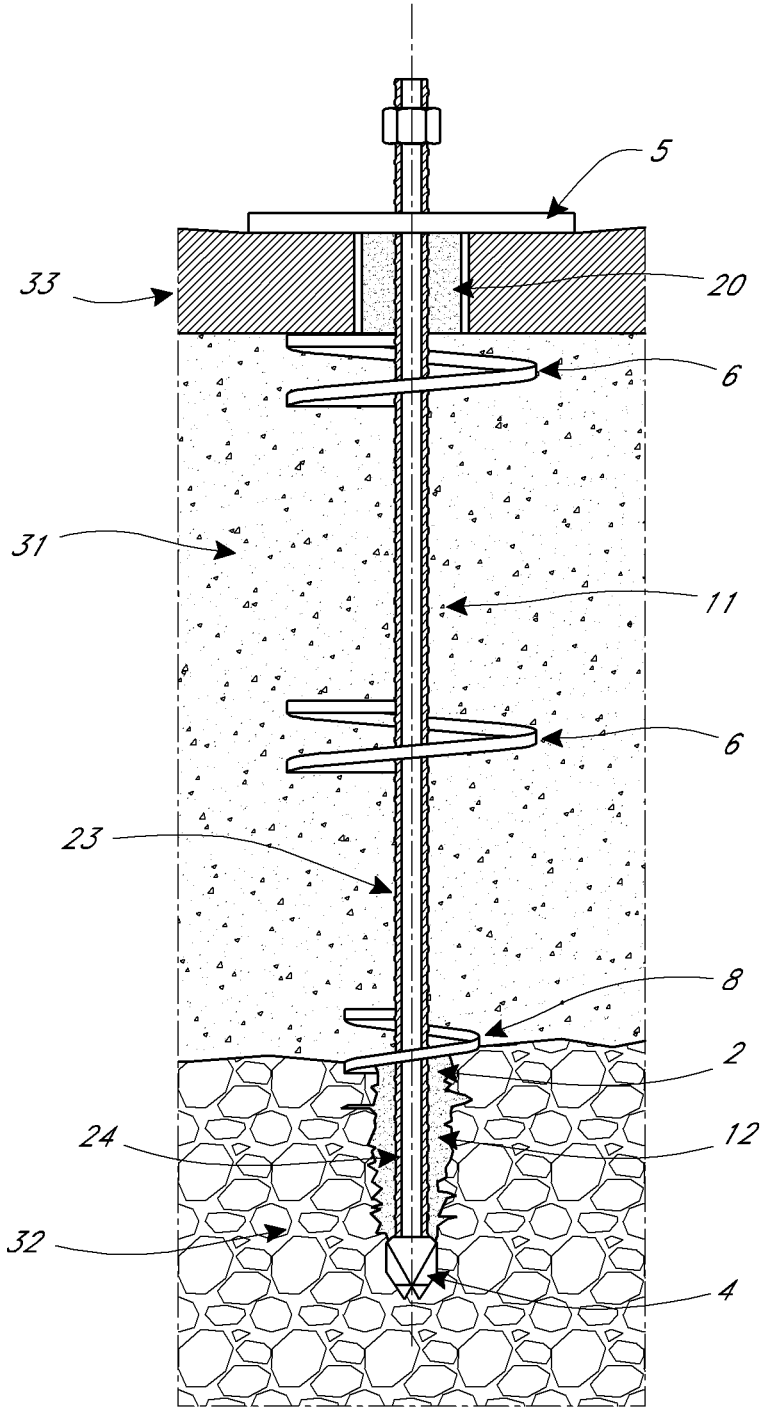
FIG. 3 is a diagrammatic illustration of an anchoring device according to a third embodiment of the invention.
Figure 4:
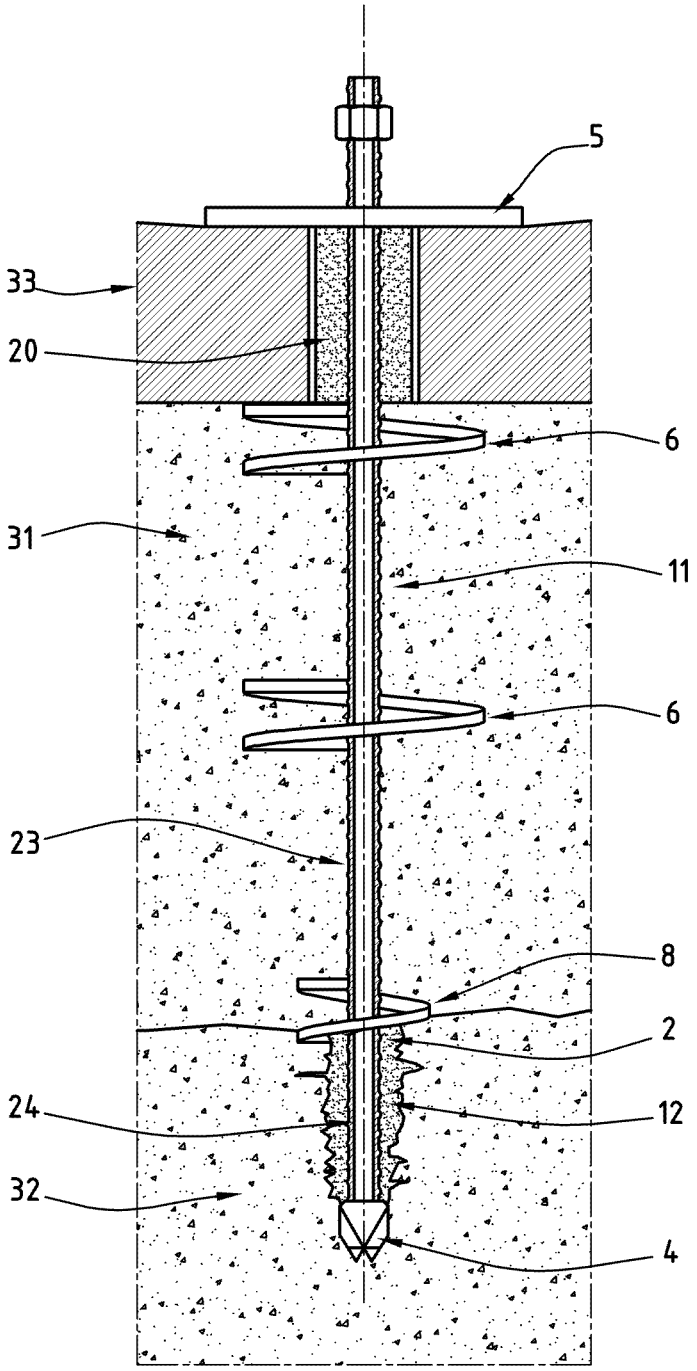
FIG. 4 is a diagrammatic illustration of an anchoring device according to a fourth embodiment of the invention.

This anchoring device is particularly interesting in the case of an anchoring soil made up of several layers with distinct compositions, and in particular a soil as illustrated in FIGS. 1 and 2, in which a first layer 31 is formed with a thickness of loose material, for example sand, gravel and generally non-consolidated materials, this first layer 31 resting on a second layer 32 made up of rocks, limestone or hardened concrete, and generally monolithic or consolidated materials, or in the case of a soil shown in FIGS. 3 and 4, in which a third layer 33, formed by silts, rests on this first layer 31.

To that end, the rod 2 has, at a predetermined distance from the ends, a drilling disc 8, a first part 23 of the rod 2 extending between the first fastening end 21 and said drilling disc 8, while a second part 24 of the rod 2 extends between the drilling disc 8 and the free drilling end 22. The first part 23 of the rod 2 is, as shown in the figures, suitable for drilling into at least the first soil layer 31, and the second part 24 of the rod 2 is suitable for being anchored, by drilling of the end of the rod 2, into the second soil layer 32.

A positioning plate 5 is mounted on the hollow rod 2 and is intended to bear on the surface of the soil, while the drilling disc 8 is arranged on the rod 2 at a predetermined length from this positioning plate 5 so the drilling disc 8 rests on the upper part of the second layer of harder soil 32. An analysis of the soils before drilling makes it possible to determine the dimension of the first soil layer 31, and therefore to determine the distance from the positioning plate 5 at which the drilling disc 8 must be arranged on the rod 2.

The first part 23 of the rod 2 has at least one helical disc 6 whereof the function is to penetrate the first loose soil layer 31 by screwing. Depending on the thickness of the loose soil layer, several helical discs 6 may be provided. The number of helical discs to be provided on the rod 2 depends on the density of the soil in which the rod must be anchored. Increasing the number of helical discs makes it possible to increase the anchoring force of the device. Therefore, the lower the soil density, the higher the number of discs must be. The diameter of the chosen discs is determined to prevent excessive force collection torques. The distance between two helical discs 6 depends on the diameter of the discs. This distance between two discs is between two and five times the diameter of the disc, and advantageously between three and four times this diameter.

The helical discs 6 extend over the first part 23 of the rod 2, between the drilling disc 8 and the positioning plate 5. For the helical discs 6 to be engaged with the first soil layer 31, the diameter of the drilling disc 8, made to penetrate the soil before the helical discs 6, must be equal to or smaller than the diameters of the helical discs 6. All of the figures show helical discs 6 with diameters equivalent to each other, and it will be understood that in accordance with what has been described above, the diameters of each helical disc 6 may vary, once a decrease in the diameter of the helical discs 6 is respected, from the closest helical disc 6 of the positioning plate 5 towards the closest helical disc 6 of the drilling disc 8. These helical discs 6 can advantageously have an entering leading bevel part, and reinforced by a filler metal. Like the hollow rod 2, these helical 6 and drilling 8 discs can be made from high strength steel. The helical 6 and drilling 8 discs are welded on the rod 2.

According to one feature of the present invention, the rod 2 extends in a second part 24, after the drilling disc 8 opposite the positioning plate 5. A bit 4 is arranged at the free end 22 of this rod 2. This self-drilling bit 4 is welded or screwed on the end of the rod 2, and has the necessary rigidity characteristics to be able to drill into a second soil layer 32, made up of consolidated or monolithic material. The second part 24 of the rod 2 will thus participate in fastening the structure by anchoring in the soil, following the drilling done by the bit 4. The length of the second part 24 of the rod 2 is then chosen to perform this anchoring over a sufficient length to stabilize the anchoring device. According to one embodiment that is not shown, a connecting sleeve can be used to increase the total length of the rod and therefore the drilling depth in the soil.

Such a device allows resistant structure anchoring, the first part 23 of the rod 2 being intended to be screwed into at least one first loose soil layer 31, which extends over a second layer 32 of a monolithic and consolidated soil, harder than the first soil layer 31, and in which the second part 24 of the rod 2 is suitable for anchoring. The drilling end of the rod, provided with the bit, initially digs out the first loose soil layer, and forms a drilling hole that facilitates the screwing action of the drilling, then helical discs in this first layer.

The bit 4 arranged at the free end of the rod 2 has a diameter larger than the diameter of the second part 24 of this rod 2. The drilling of the soil by the bit 4 then creates a cavity 12 in which the second part 24 of the rod 2 extends after the bit 4. In order to anchor the rod 2 in the soil, cement or synthetic resin is injected into this cavity 12 to keep the rod 2 in position relative to at least the second soil layer 32. To that end, at least part of the rod 2 and the bit 4 are pierced with holes, not shown, for the injection.

This cement or resin can be injected over a more or less large part of the rod 2 of the anchoring device. In a first embodiment shown in FIG. 1, only the second part 24 of the rod 2 and the bit 4 are pierced with injection holes.

In a second embodiment shown in FIG. 2, the assembly of the rod 2 and the bit 4 are pierced with injection holes, so that the cement or resin spreads around the entire rod 2, in the cavity 12 formed by the bit 4 for the second part 24 of the rod 2, and into an additional cavity 11 formed by the drilling disc 8 and the helical discs 6 for the first part 23 of the rod 2.

The choice of using an anchoring device according to either of the embodiments mentioned above is in particular made by the thicknesses of the different layers of each soil. If the first soil layer 31 and the third soil layer 33 require that the first part 23 of the rod 2 be large, it may be deemed preferable for the stability of the anchoring to inject cement over the entire rod 2.

However, the composition of the third soil layer 33, made up of silts, makes it impossible to inject cement or resin around the first part 23 of the rod 2, which extends in this third layer. The additional cavity 11 formed by the passage of the drilling disc 8 in the third soil layer 33 is immediately plugged back up after the passage of the drilling disc 8. This can also be the case in the first soil layer 31, in particular if this layer is made up of sand.

In order to form a space in which the injected resin or cement can be inserted, as illustrated by FIGS. 3 and 4, a cylindrical casing 20 is formed around the first part 23 of the rod 2. The casing 20 extends between the positioning plate 5 and the helical disc 6 closest to said plate, and rests against the plate 5 and said disc. Therefore, after the passage of the discs, the loose material making up the third soil layer 33 cannot plug up the additional cavity 11 formed by the discs 6 and 8, and cement can be injected between the rod 2 and the cylindrical casing 20. It should be noted that, in one embodiment that is not shown, the casing 20 can be provided between two helical discs 6 to allow cement to be injected around the rod in the first soil thickness 31.

According to one alternative, the cylindrical casing 20 is formed around the first part 23 of the rod 2, between the positioning plate 5 and the drilling disc 8. In a fifth embodiment shown in FIG. 5, a cylindrical casing 40 is formed around the first part 23 of the rod 2 between the positioning plate 5 and the drilling disc 8 and this casing 40 has a variable diameter.

In general, the variable diameter of the cylindrical casing 40 varies between a large diameter and a small diameter that is larger than the diameter of the second part 24 of the rod 2.

Figure 5:
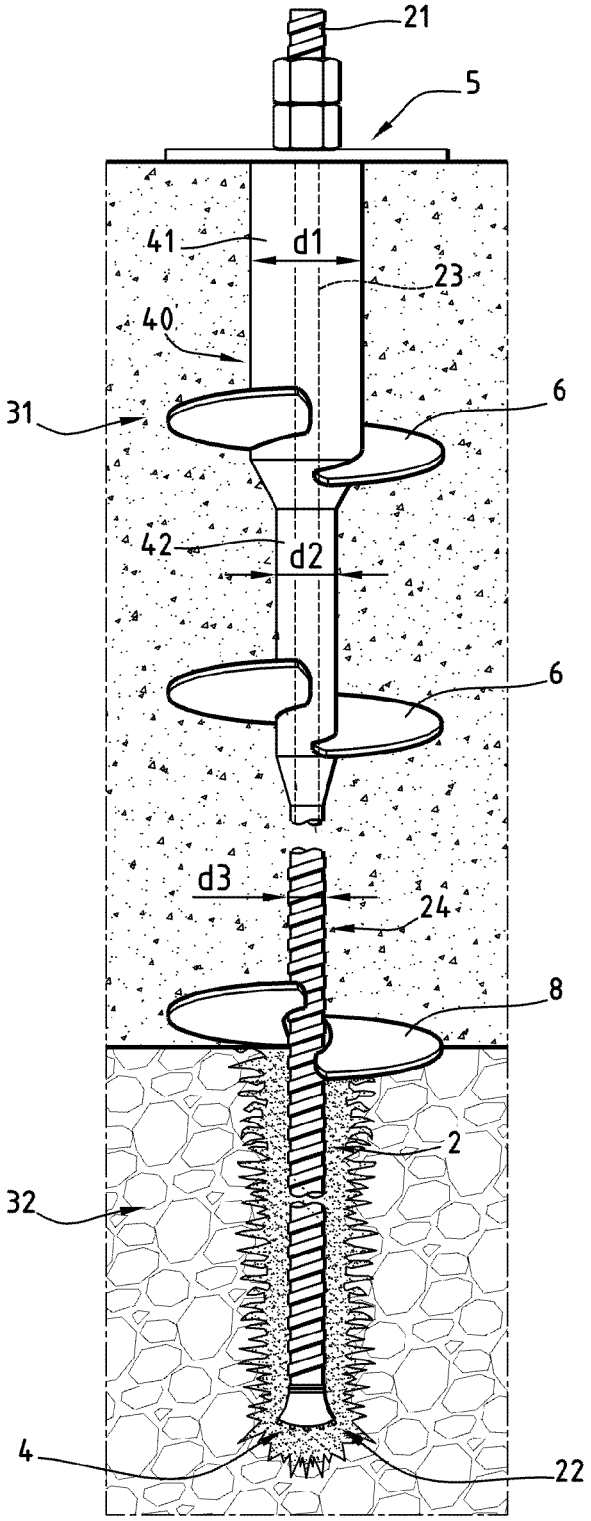
FIG. 5 is a diagrammatic illustration of an anchoring device according to a fifth embodiment of the invention.

As shown in FIG. 5, the cylindrical casing 40 has a first section 41 extending from the positioning plate 5 and having a first diameter d1 followed by a second section 42 extending up to the drilling disc 8 and having a second diameter d2 smaller than the first diameter d1 and larger than the diameter d3 of the second part 24 of the rod 2.

In this embodiment as well, at least part of the rod 2 and the bit 4 are pierced with holes for injecting cement or a synthetic resin.

Therefore, according to different embodiments, only the part of the rod 2 situated between the drilling disc 8 and the bit 4 is pierced with holes for injecting cement or resin or only the part of the rod 2 situated between the last helical disc 6 and the drilling disc 8 is pierced with holes for injecting cement or a synthetic resin.

According to still another embodiment, the holes for injecting cement or synthetic resin are pierced over the entire length of the second part 24 of the rod 2 and on the bit 4.

As shown in FIG. 5, holes are also pierced on the first part 23 of the rod 2 for filling chambers inside the casing 40 with cement or synthetic resin. This filling increases the strength of the casing and also makes it possible to eliminate any internal corrosion.

The sections 41 and 42 of the cylindrical casing 40 are welded to each other and they support helical force discs 6. The threaded or smooth hollow rod 23 forms the main strength column and allows all types of catching in the upper part as well as the connections with a device for injecting cement or synthetic resin.

As shown in the figures, the hollow rod 2 forming the anchoring device has a constant diameter over the entire length of the anchoring device. It will be understood that a rod 2 with a constant diameter allows simplified industrialization of the anchoring device, but could be replaced in one alternative with a variable diameter rod. As one non-limiting example, the diameter of the parts of the rod 2 not covered with a cylindrical casing 20 could be larger than the diameter of the rod surrounded by said casing 20. These diameter variations of the rod must, however, make it possible to produce the aforementioned characteristics, i.e. in particular the bit 4 must have a diameter larger than the diameter of the second part 24 of the rod 2.

Likewise, the figures show a threaded hollow rod 2. It will be understood that this rod can be threaded or smooth, and for example can have a mixed profile. As an example, the rod 2 can be threaded on the second part 24 extending between the drilling disc 8 and the bit 4, and this rod 2 can be smooth in the part 23 surrounded by the cylindrical casing 20.

Such an anchoring device makes it possible to fasten a structure or building in soils having layers with different compositions. The anchoring device is placed by screwing using a roto-striker, supported by a drilling arm or by a submerged installation depending on the considered land or water application. The device can then extend in these different successive layers strictly vertically as shown, or with a different orientation without going beyond the scope of the invention, once the bit and the second part of the rod are anchored in a second monolithic or consolidated soil layer, as illustrated in FIGS. 1 to 3, or loose as illustrated in FIG. 4, and once this second layer is covered with at least a first loose soil layer, and the first part of the rod and the associated discs are screwed into at least the first loose soil layer.

Such a mixed anchoring device, combining the drilling and screwing anchoring features, via a single rod, makes it possible, using a single device, to take all of the anchoring forces into account, i.e. the extraction and bending forces on one hand, and compression and buckling forces on the other.

The mixed anchoring device according to the invention is capable of withstanding various stresses, and primarily bending forces by strengthening the larger diameter of the rod 2. The bending forces are generated by variable forces with an orientation between 0 and 90°.

What is claimed is:

1. A method for anchoring a device in multilayer soil, comprising:

(a) analyzing the multilayer soil to determine the depth, hardness and density of at least a first and a second layer of the multilayer soil, wherein the second layer is harder than the first layer;

(b) preparing an anchoring device for positioning in the multilayer soil by:

(i) attaching a self-drilling bit to a bottom end of a hollow rod, (ii) attaching a drilling disc to the rod at a position above the self-drilling bit, (iii) attaching at least one helical disc to the rod above the drilling disc, wherein the number of helical discs and the diameter of each helical disc is selected based on the depth and density of the first layer to provide a sufficient anchoring force within the second layer without causing excessive torque on the at least one helical disc during drilling, and (iv) attaching a positioning plate to the rod at a distance from the drilling disc such that the distance from the bottom of the drilling disc to the bottom of the positioning plate is approximately equal to the depth of the first layer; and (c) drilling the anchoring device into the multilayer soil until the drilling disc rests on top of the second layer and the positioning plate rests on top of the first layer.

2. The method according to claim 1, wherein step (a) further comprises analyzing a third layer of the multilayer soil which rests on the first layer of the multilayer soil.

3. The method according to claim 2, wherein the third layer is formed by silts.

4. The method according to claim 1, wherein step (b)(iii) comprises attaching more than one helical disc to the rod and the distance between adjacent helical discs is between about two and about five times the diameter of one of the helical discs.

5. The method according to claim 4, wherein the distance between adjacent helical discs is between about three and about four times the diameter of one of the helical discs.

6. The method according to claim 1, wherein the diameter of the drilling disc is about equal to or smaller than the diameter of the at least one helical disc.

7. The method according to claim 1, wherein the at least one helical disc comprises more than one helical disc and the diameter of each helical disc is not equivalent.

8. The method according to claim 7, wherein the diameter of each helical disc progressively decreases toward the drilling disc.

9. The method according to claim 1, wherein the at least one helical disc comprises an entering leading bevel part.

10. The method according to claim 1, wherein the step of attaching in step (b)(ii) and step (b)(iii) comprises welding the at least one helical disc and the drilling disc to the rod.

11. The method according to claim 1, wherein step (c) further comprises creating a cavity in which the rod extends after the bit.

12. The method according to claim 11, further comprising injecting cement or synthetic resin into the cavity.

13. The method according to claim 12, wherein the cement or synthetic resin fills holes pierced into the rod so as to help anchor the rod in the soil.

14. The method of claim 13, wherein only a second portion of the rod is pierced with holes.

15. The method of claim 12, wherein the cement or synthetic resin fills holes pierced into the bit so as to help anchor the rod in the soil.

16. The method of claim 12, further comprising preventing the cavity from being plugged by loose material from either the first or second layer of soil by surrounding at least a portion of the rod with a cylindrical casing.

17. The method of claim 16, wherein the cement or synthetic resin is injected between the rod and the cylindrical casing.

18. The method of claim 16, wherein the cylindrical casing has at least a first section extending form the positioning plate.

19. The method of claim 18, wherein the cylindrical casing is formed around a first portion of the rod, between the positioning plate and the at least one helical disc closest to the positioning plate.

20. The method of claim 12, wherein the anchoring device is drilled into the soil in an orientation other than strictly vertical.

* * * * *